United States Patent [19]

Konrad

[11] Patent Number: 4,664,274

[45] Date of Patent: May 12, 1987

[54] BLOOD-SAMPLING TUBE

[75] Inventor: Franz Konrad, Regau, Austria

[73] Assignee: C. A. Greiner & Sohne Gesellschaft mbH, Kremsmunster, Austria

[21] Appl. No.: 821,996

[22] Filed: Jan. 24, 1986

[30] Foreign Application Priority Data

Jan. 24, 1985 [AT] Austria ..... 186/85

[51] Int. Cl.[4] ..... B65D 41/20

[52] U.S. Cl. ..... 215/232; 215/247

[58] Field of Search ..... 215/247, 249, 248, DIG. 3, 215/232

[56] References Cited

U.S. PATENT DOCUMENTS

| | | | |
|---|---|---|---|
| 2,603,218 | 7/1952 | Rane | 215/247 |
| 2,783,908 | 3/1957 | Winfield | 215/247 |
| 4,254,884 | 3/1981 | Maruyama | 215/247 X |

FOREIGN PATENT DOCUMENTS

| | | | |
|---|---|---|---|
| 609482 | 9/1960 | Italy | 215/DIG. 3 |
| 263437 | 5/1964 | Netherlands | 215/247 |
| 397953 | 2/1966 | Switzerland | 215/DIG. 3 |

*Primary Examiner*—Donald F. Norton

*Attorney, Agent, or Firm*—Karl F. Ross; Herbert Dubno

[57] ABSTRACT

A blood-sampling tube assembly comprises a cap fitted onto the open end of a blood-sampling tube and having inner and outer walls between which the walls of the tube is snugly received. According to the invention, the cap is formed with an outwardly open and upwardly open compartment containing a self sealing membrane pierceable by a needle and held in place by a laminate, e.g. aluminum foil and a heat sealing layer, bonded to an end wall of the cap bridging the inner and outer walls and closing the membrane within the compartment.

13 Claims, 3 Drawing Figures

BLOOD-SAMPLING TUBE

CROSS REFERENCE TO RELATED APPLICATION

This application is related to my commonly owned copending application Ser No. 690,148 filed Jan. 10, 1985.

FIELD OF THE INVENTION

My present invention relates to a blood-sampling tube and, more particularly, to a blood-sampling tube with a pull-off cap having a sealing laminate and a self-sealing membrane which can be pierced by a needle.

BACKGROUND OF THE INVENTION

Evacuated or evacuatable blood-sampling tubes generally have a hollow cylindrical vessel, e.g. of glass or possibly of synthetic resin, which may be surmounted by a removable cap.

These tubes can be used with a blood-sampling device whose hollow cylindrical holder is equipped with a double-pointed needle, one point of which is inserted into a blood vessel of the patient while the other point is thrust through the self sealing membrane of the sampling tube when the latter is forced into the holder The suction applied by the vacuum in the tube draws the blood into the latter.

The open end of the tube is closed by a cap which can hold in place a preferably constant wall thickness foil covering a portion of the cap and retained by a heat-sealable layer, and the self-sealing elastomeric membrane, e.g. of silicone rubber.

The foil is preferably of aluminum and forms the laminate with the heat sealing adhesives.

A sampling tube for a vacuum blood sampling system is described in German patent document-open application DE-OS No. 29 08 819. The closure element is here formed by a screw cap which has an opening and whose end presses the membrane of a self sealing material adapted to be pierced by the needle against the mouth of the tube.

This sampling tube requires that screw threads be provided both on the open end of the tube and on the cap. Moreover, the application of the cap by screwing it onto the tube must be carried out with care to ensure that the membrane will seal properly against the tube and the cap.

Access to the contents of the tube requires the time-consuming and tedious unscrewing of the cap.

Furthermore, with this system, one cannot readily detect whether or not the tube has been tampered with, i.e. opened in a manner unintended by the physician or the test laboratory. Finally it has been found that, with long storage, especially when the tubes are constituted or microporous plastic, there may be a failure of the vacuum within the tube.

Even a cap which has a flange upon which the closure element is applied by means of the heat sealable layer and wherein the sealing membrane lies outside the closure element but within the cap, is not always satisfactory. While such caps are effective in use, they pose problems of fabrication, particularly in making and storing the caps and or closure elements.

OBJECTS OF THE INVENTION

It is the principal object of the present invention to provide an improved blood sampling tube whereby the aforementioned drawbacks are obviated.

Another object of my invention is to provide a sampling tube of the last mentioned general type but in which the closure element can be fabricated and handled more easily.

SUMMARY OF THE INVENTION

These objects and other which will become apparent hereinafter are attained, in accordance with the present invention by providing a cap having a pair of walls adapted to receive a tube wall surrounding the open ends of the tube between cap and forming a compartment open axially outwardly within the innermost of these walls. According to the invention, this compartment receives a self sealing membrane of elastomeric material, e.g. silicone rubber, and is closed by the heat sealable layer of the closure element, i.e. the foil laminate.

Consequently, the closure element by means of the heat sealable layer closes the cap at a upper end and within the compartment receiving the sealing membrane. This construction has been found to simplify handling of the tube with secure sealing of the latter so that vacuum losses are avoided, greatly facilitates the ability to handle the closure elements or caps, and materially simplifies the fabrication thereof.

According to a feature of the invention, the cap has a bottom portion, i.e. a partition wall extending transversely to the axis and the aforementioned walls and formed on the inner wall of the double wall structure receiving the wall of the tube. This partition can serve as a seat for the membrane and has been found to ensure a tight fit of the inner wall against the inner surface of the tube to provide especially secure sealing against loss of vacuum.

According to yet another feature of the invention, the cap is provided with an end wall bridging the two cylindrical walls of the cap and against which the rim of the sampling tube is pressed when the wall of the sampling tube is enclosed between the walls of the cap.

Preferably, moreover, the transverse partition extends over the entire cross section of the compartment and the entire cross section of the cap within the inner wall without interruption so that especially high radial outward forces are provided when the tube is thrust into the double wall structure of the cap. According to yet another feature of the invention a sleeve is formed within the inner cap wall, preferably on this partition and receives the sealing membrane. This construction has been found to greatly reduce the volume of the sealing membrane which is required and represents a significant saving in cost because of the comparatively high cost of the material with which the sealing membrane is formed.

According to another feature of the invention, on the inner surface surrounding the sealing membrane, i.e. on the inner surface of the sleeve when one is provided or on the inner wall of the cap, formations are provided which are intended to project into the sealing membrane to retain it in place without movement Such formations can include inwardly directed wedge-cross sections ribs which can be provided circumferentially along the interior of the sleeve or the inner wall of the cap.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
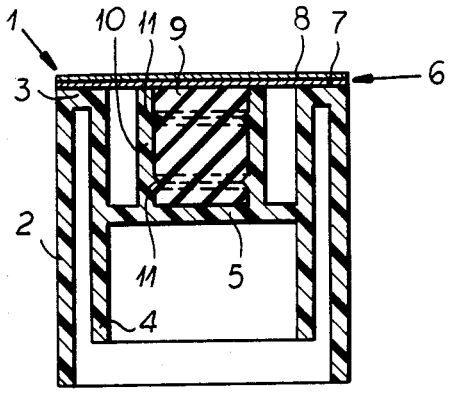
FIG. 1 is an axial section through a cap provided with a closure in accordance with the invention.
Figure 2:
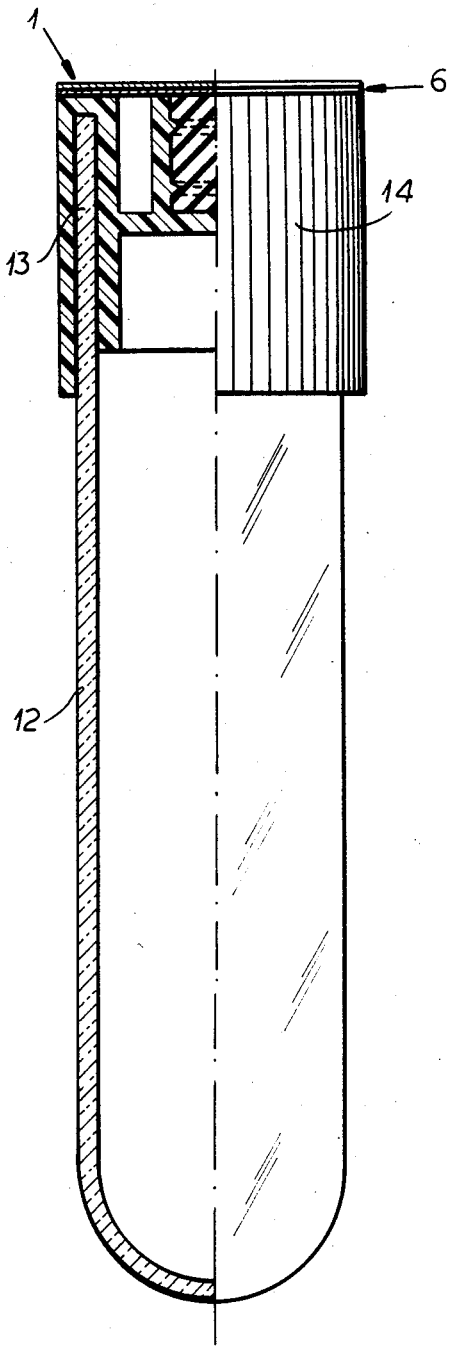
FIG. 2 is an elevational view broken away over half of the view to show both the cap and the sampling tube in cross section.

The best mode embodiment of the invention is shown in FIGS. 1 and 2. This embodiment is a sampling tube assembly for the taking blood samples in the manner described, which comprises a cap of an injection moldable synthetic resin, such as polethylene, as represented at 1 and here shown to have a cylindrical configuration.

The cap comprises an outer wall 2, an end wall 3 and an inner wall 4, the inner and outer walls defining between them an annular clearance which sealing receives a wall 13 of a sampling tube which is pressed into the cap until the rim of its open mouth seats against the end wall 3.

The inner wall 4 is formed unitarily, i.e. in one piece, with a partition 5 forming a bottom for an axially upwardly open compartment which is here defined by a sleeve 10 receiving a sealing membrane 9. In this embodiment the sealing membrane 9 is a plug of a self-sealing material which can be pierced by a needle and may be composed of silicone rubber.

The partition or compartment bottom 5 provides the cap with an extraordinarily high stiffness against inward distortion and ensures that when the cap is pressed onto the mouth of the tube, the inner wall of the cap 4 will be pressed sealingly with great force against the inner surface of the tube wall 13.

The cap 1 is provided at its upper end with a closure element 6 in the form of a laminate of a heat sealing layer 7 and an aluminum foil 8 bonded to the heat sealing layer and of uniform wall thickness. Such foils and heat sealing layers form laminates as is known and preferably the aluminum foil can have a thickness of about 0.3 millimeters. Advantageously, the foil thickness ranges between 0.1 and 1 millimeter.

The heat sealing of the laminate 6 is effected on the web bridging the inner and outer walls 2 and 4 and forming the end wall 3 of the cap, by means of the layer 7.

Below the closure element 6 is found the sealing membrane 9 which, as noted, can be a plug and preferably can have a thickness of 1.5 to 3 millimeters, being composed of silicone rubber.

The sleeve 10 which can have a diameter of about half the diameter across the inner wall 4, limits the amount of membrane material which is required.

To secure the sealing membrane 9 in place within the sleeve 10, the inner wall of the latter can have wedge shaped ribs 11 projecting into the sealing membrane. The sealing membrane has the characteristic that, after it is pierced by a double ended needle of the hollow cylindrical holder used to draw the blood from the patient, withdrawal of the needle from the membrane will allow the membrane to seal itself against contamination and escape of the blood sample.

The tube 12 is preferably composed of glass and the external surface of the outer wall 2 of the cap can be grooved or milled as represented at 14 to enable the cap to be firmly gripped.

The interior space of the tube 12 is under vacuum and this can be generated after heat sealing the closure 6 and applying the sealing cushion 9, to draw air out of the tube.

The handling and operation of the blood sampling for the taking of blood samples corresponds to that described in the aforementioned German open application No. 29 08 817.

Figure 3:
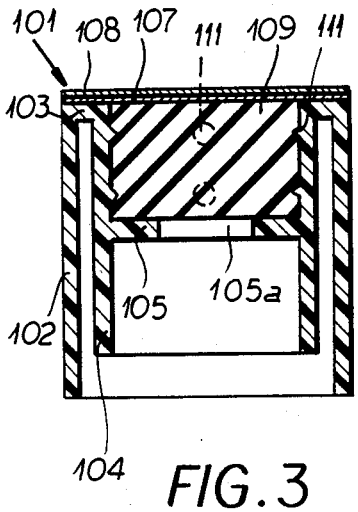
FIG. 3 is a view similar to FIG. 1 illustrating another embodiment of the invention.

As can be seen from FIG. 3, it is possible to modify the embodiment described in various ways. One obvious way of modifying the embodiment of FIGS. 1 and 2 is to substitute a tube 12 composed of plastic for the glass tube. It is also possible to substitute a plastic or synthetic resin foil for the aluminum foil 8.

As shown in FIG. 3, however, a modification that has been found to be highly advantageous provides the partition instead of as a full-section partition, as a ring as shown at 105 in FIG. 3. In this case, the ring can have the same inner diameter as the sleeve 10 although, as is also apparent from FIG. 3, the sleeve 10 can be omitted entirely so that the sealing membrane 109 can completely fill the space above the ring 105 within the inner wall 104 of the cap 101 In this embodiment as well, I have shown in place of the wedge-section ribs 11 on the inner wall are 104, other formations which are essentially equivalent, e.g. hemispherical bosses 111 which are spaced around the inner wall periphery as illustrated. Instead of hemispherical bosses, individual pyramid-shaped formations can be used.

A window 105*a* is provided within the ring 105 having the inner diameter of the sleeve 10 and through which the needle can pass. Thus one difference between the embodiments of FIGS. 1 and 2 and that of FIG. 3 is that the needle does not have to pierce the partition in the embodiment of FIG. 3.

Naturally, the outer wall 102 and the metal foil 108 and its heat sealing layer 107 are provided in this embodiment as well, the heat sealing layer 107 bonding to the transverse web 103.

Of course the sampling tube assembly illustrated and described need not only be used for blood sampling, and can be used for the sampling of other body fluids and similar purposes.

I claim

1. A blood sampling tube assembly which comprises:

a sampling tube having an open end and a wall surrounding a mouth of said tube and said open end; and a cap closing said mouth of said tube and formed with inner and outer walls snugly receiving said wall of said tube between them and having an end wall interconnecting said inner and outer walls against which a rim of said sampling tube can be pressed, said cap being formed with an outwardly open compartment within said inner wall closed by a laminate having a heat sealable layer bonded to said cap at said end wall and retaining within said compartment a self-sealing plug penetrable by a needle and sealing upon withdrawal of a needle therefrom.

2. The assembly defined in claim 1 wherein said cap is formed with a transverse partition at an intermediate location over the height of said inner wall, said plug being seated against said partition.

3. The assembly defined in claim 2, further comprising a sleeve extending axially from said partition and spaced from said inner wall while defining said compartment within said sleeve, said plug being received in said sleeve.

4. The assembly defined in claim 3 wherein said sleeve is provided with formations engaging in said membrane for retaining said plug in place.

5. The assembly defined in claim 2 wherein said partition extends fully across the cross section within said inner wall.

6. The assembly defined in claim 2 wherein said partition is in the form of a rim having a central opening aligned with a portion of said plug to be pierced by a needle.

7. The assembly defined in claim 6 wherein said plug substantially fills said compartment and said compartment is bounded by said laminate, said inner wall and said partition; said inner wall being formed between said partition and said laminate with formations engaging in said sealing plug.

8. The assembly defined in claim 7 wherein said formations are wedge-section ribs.

9. The assembly defined in claim 7 wherein said formations are spaced apart elements formed on said inner wall 10. The assembly defined in claim 4 wherein said formations are wedge-section ribs formed on an inner surface of said sleeve.

11. The assembly defined in claim 4 wherein said formations are spaced apart individual bosses projecting from said sleeve into said plug.

12. The assembly defined in claim 1 wherein said laminate comprises an aluminum foil bonded to heat sealing layer.

13. The assembly defined in claim 12 wherein said aluminum foil has a constant cross section.

* * * * *